US006065237A

United States Patent [19]

Hillesland

[11] Patent Number: 6,065,237

[45] Date of Patent: May 23, 2000

[54] PISTOL

[76] Inventor: Gene G. Hillesland, 1430 Nashville Dr., Tallahassee, Fla. 32304

[21] Appl. No.: 08/942,421

[22] Filed: Sep. 29, 1997

[51] Int. Cl.[7] ..... F41A 9/20; F41C 25/00; B25C 1/14

[52] U.S. Cl. ..... 42/1.09; 227/176.1; 227/9; 227/10; 227/15

[58] Field of Search ..... 227/176.1, 9, 10, 227/15; 42/1.09, 15, 39.5

[56] References Cited

U.S. PATENT DOCUMENTS

| | | | |
|---|---|---|---|
| 450,900 | 4/1891 | Wahlquist | 42/15 |
| 1,073,312 | 9/1913 | Woods | 42/1.09 |
| 2,856,716 | 10/1958 | Copoton | 42/39.5 |
| 2,865,126 | 12/1958 | Dardick | 42/39.5 |
| 4,162,033 | 7/1979 | Poeroy | 227/10 |
| 4,368,588 | 1/1983 | Jochum et al. | 42/1 R |
| 4,760,834 | 8/1988 | Chevalier | 124/51 R |
| 5,036,611 | 8/1991 | Schmid | 42/39.5 |
| 5,299,373 | 4/1994 | Breiner | 42/39.5 |
| 5,470,008 | 11/1995 | Rodak | 227/176 |

*Primary Examiner*—Charles T. Jordan
*Assistant Examiner*—Denise J Buckley
*Attorney, Agent, or Firm*—Peter Loffler

[57] ABSTRACT

A starter pistol for firing blank cartridges is generally in the shape of a typical medium duty upholstery stapler. A magazine having at least one chamber each holding a cartridge is fed into an open channel on the bottom of the device. A trigger is operatively connected to a firing pin and actuates the firing pin upon squeezing of a lever of the trigger by an operator. The trigger is also operatively connected to an advancement mechanism that advances each cartridge laden chamber into proper position for firing.

27 Claims, 4 Drawing Sheets

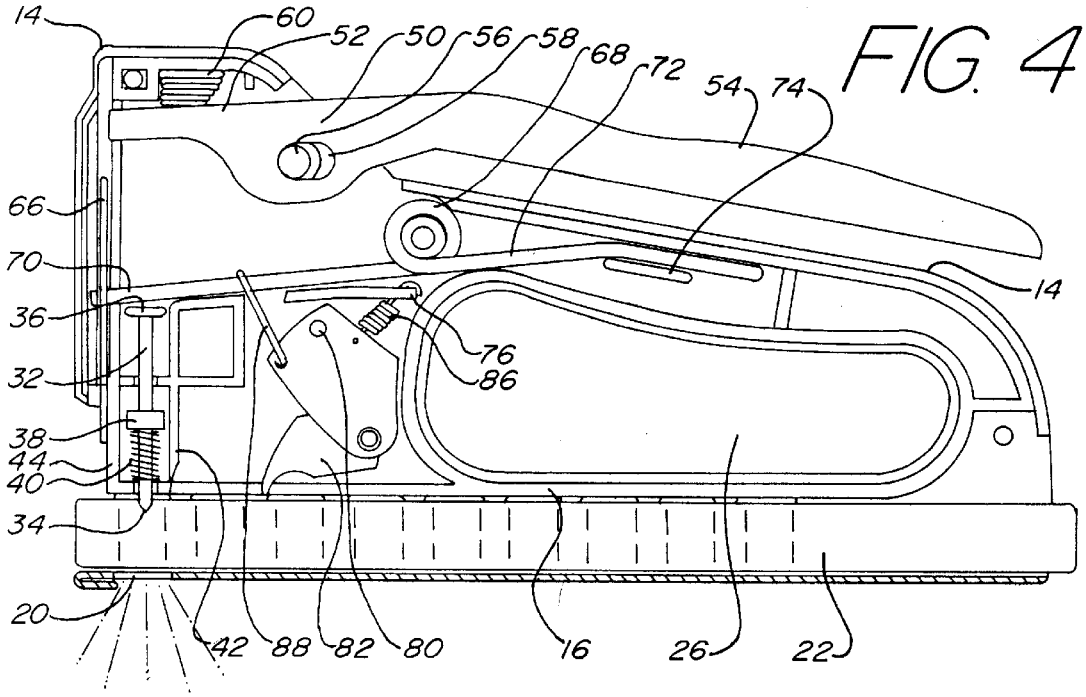
FIG. 4
FIG. 5
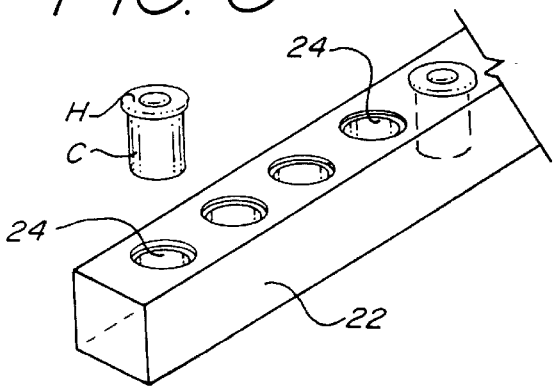
FIG. 6
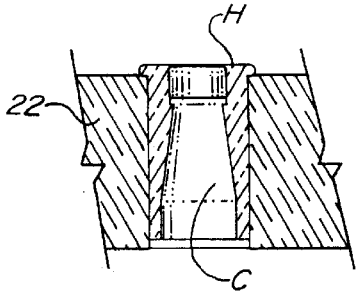

PISTOL

BACKGROUND OF THE INVENTION

1. Field of the Invention

The present invention relates to a starter pistol having a nontraditional shape and firing system.

2. Background of the Prior Art

Starter pistols are common sights at many sporting events. These pistols, which fire blank cartridges to produce a loud bang, typically lack a bore-through barrel relative to a standard pistol but are otherwise very similar in appearance to a standard pistol.

A problem with starter pistols is that, due to their realistic appearance, they are a lure to many people especially children. These children want to play with the starter pistol and may try to steal them. As starter pistols can be very dangerous if misused, they do not belong in a child's hand. Furthermore, a person armed with a standard firearm, such as a police officer, may mistake the starter pistol for a standard pistol and may shoot the child if he feels threatened.

Another problem with starter pistols is their use in crime. Due to the pistol's realistic appearance, many criminals opt for a starter pistol for use in robberies. These criminals prefer the starter pistol because it is less expensive and because the criminal can bypass the various gun control laws in many jurisdictions. Laws have been enacted in many jurisdictions requiring the end of the starter pistol's barrel to be painted orange in order to distinguish a starter pistol from a standard pistol. While this solution diminishes the potential for a child holding a starter pistol from being shot, it fails to lessen the attraction people have toward the pistol and does not prevent a criminal from masking over the orange paint.

As there is no adequate substitute for the bang produced by the starter pistol to begin a sports contest, the starter pistol will continue in use at many sports venues. Therefore, there is a need in the art for a starter pistol that lacks the appeal of a realistic appearance of a standard pistol and that eliminates the potential for mistaking the starter pistol with a standard pistol.

SUMMARY OF THE INVENTION

The pistol of the present invention addresses the aforementioned needs in the art. The pistol is similar in appearance to a typical medium duty upholstery stapler. The lever, which is part of the trigger, actuates the firing pin which acts on a cartridge positioned at the lower portion of the device. The internal actuation parts are similar in design and operation to a standard stapler. A magazine slides within a chamber and an advancement mechanism positions a fresh cartridge below the firing pin after each firing.

As the pistol of the present invention looks similar to a stapler, the attractiveness of the device to a child is greatly diminished. The criminal use of the device is eliminated as a criminal would look pretty silly attempting to rob a bank with what is, in appearance, a stapler.

BRIEF DESCRIPTION OF THE DRAWINGS

FIG. 4 is a side elevation view of the pistol, with the cover removed, at the point of firing.

FIG. 5 is a partial perspective view of the magazine.

FIG. 6 is a cutaway view of one of the chambers of the magazine with a cartridge therein.

Similar reference numerals refer to similar parts throughout the several views of the drawings.

DESCRIPTION OF THE PREFERRED EMBODIMENT

Figure 1:
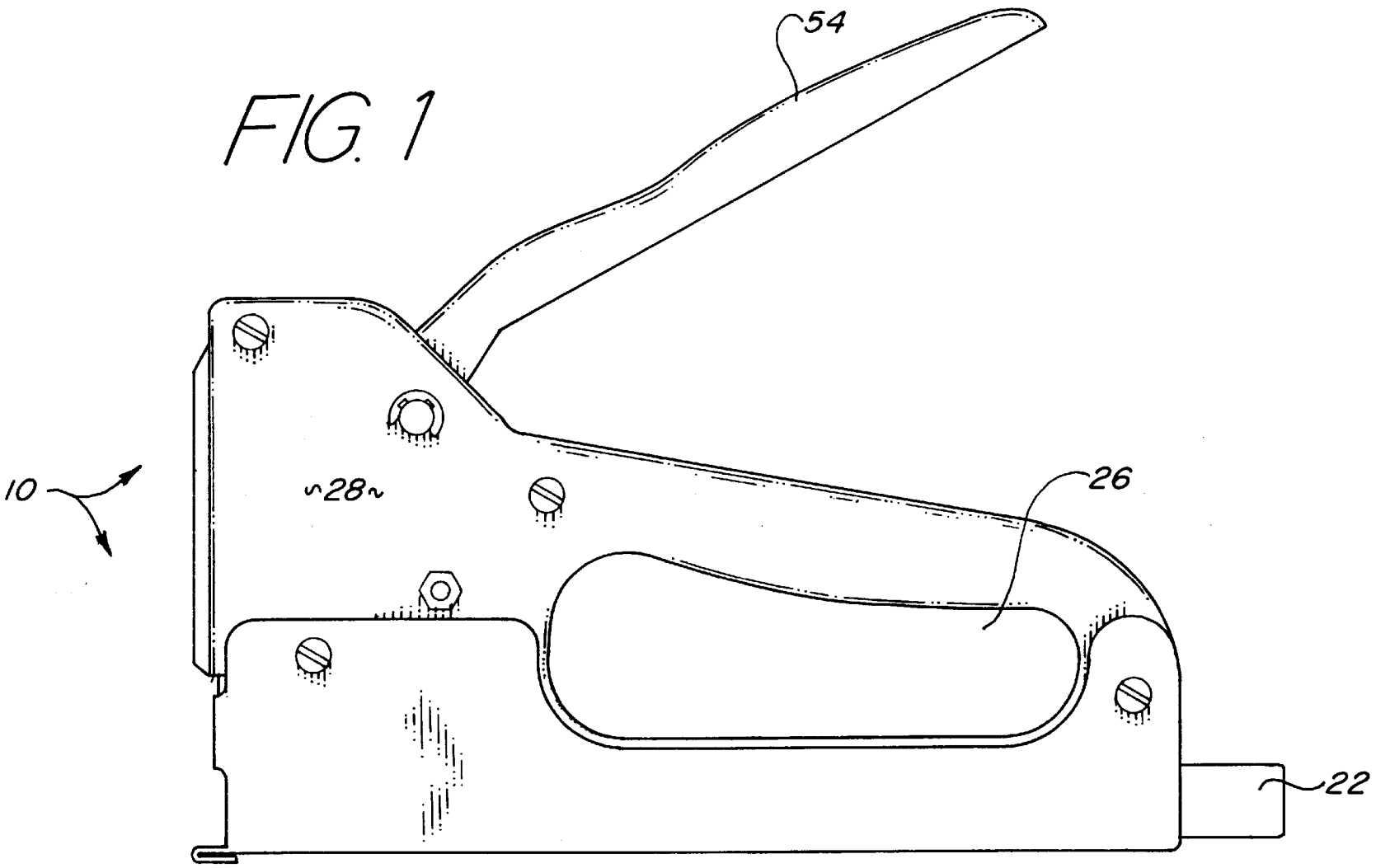
FIG. 1 is a side elevation view of the pistol of the present invention.

Referring now to the drawings, it is seen that the pistol of the present invention, generally denoted by reference numeral 10, is comprised a housing 12 having an upper wall 14 and a lower wall 16 and an open channel 18, having both ends open, positioned below the lower wall 16. An opening 20 is located on an end of the open channel 18. A magazine 22 having at least one chamber 24 is adapted to slide within the open channel 18. An open portion 26 serves as a hand grip. A cover 28 is removably located on the housing 12 for maintenance access to the internal portion of the housing 12.

Figure 2:
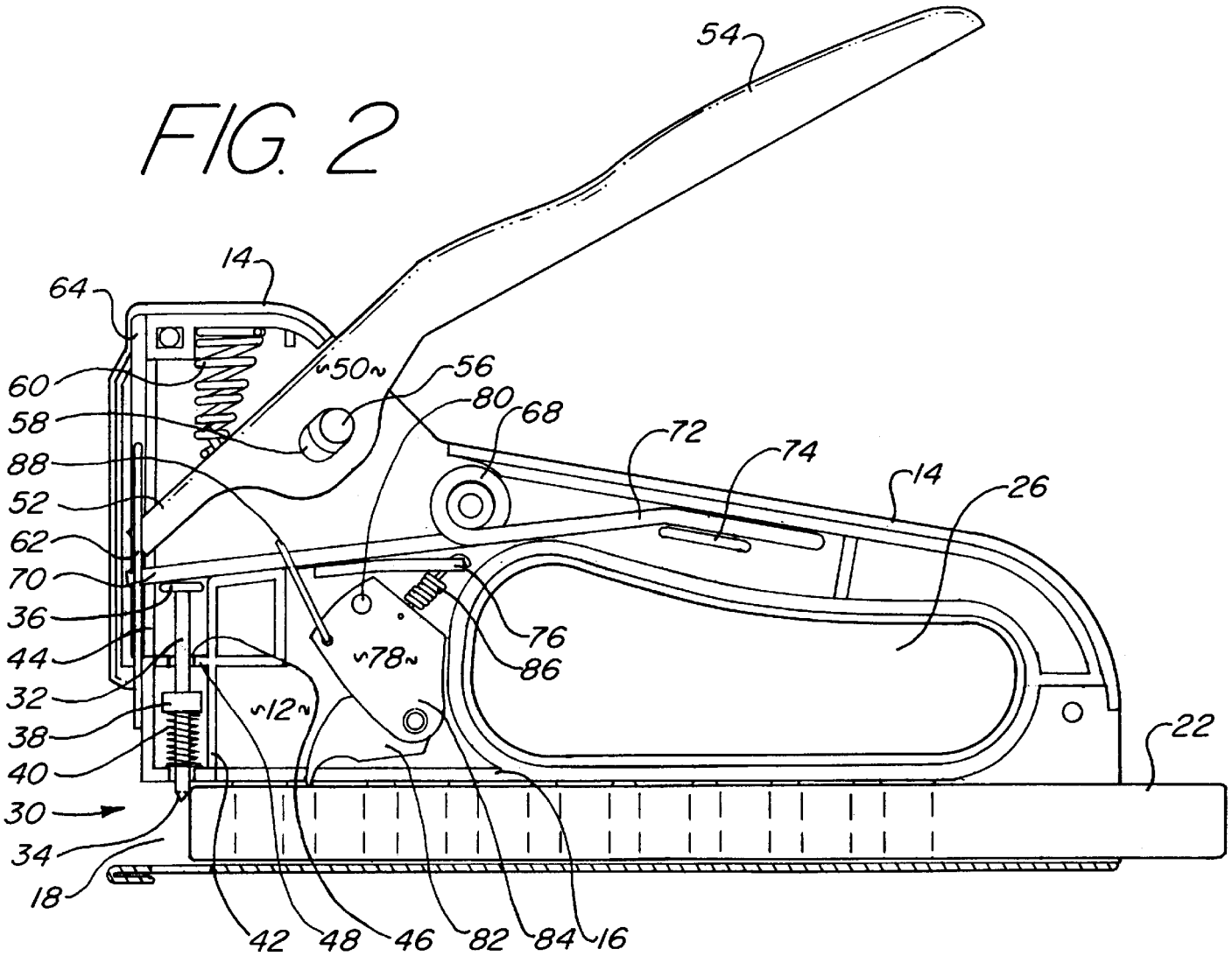
FIG. 2 is a side elevation view of the pistol, with the cover removed, in a ready state.
Figure 3:
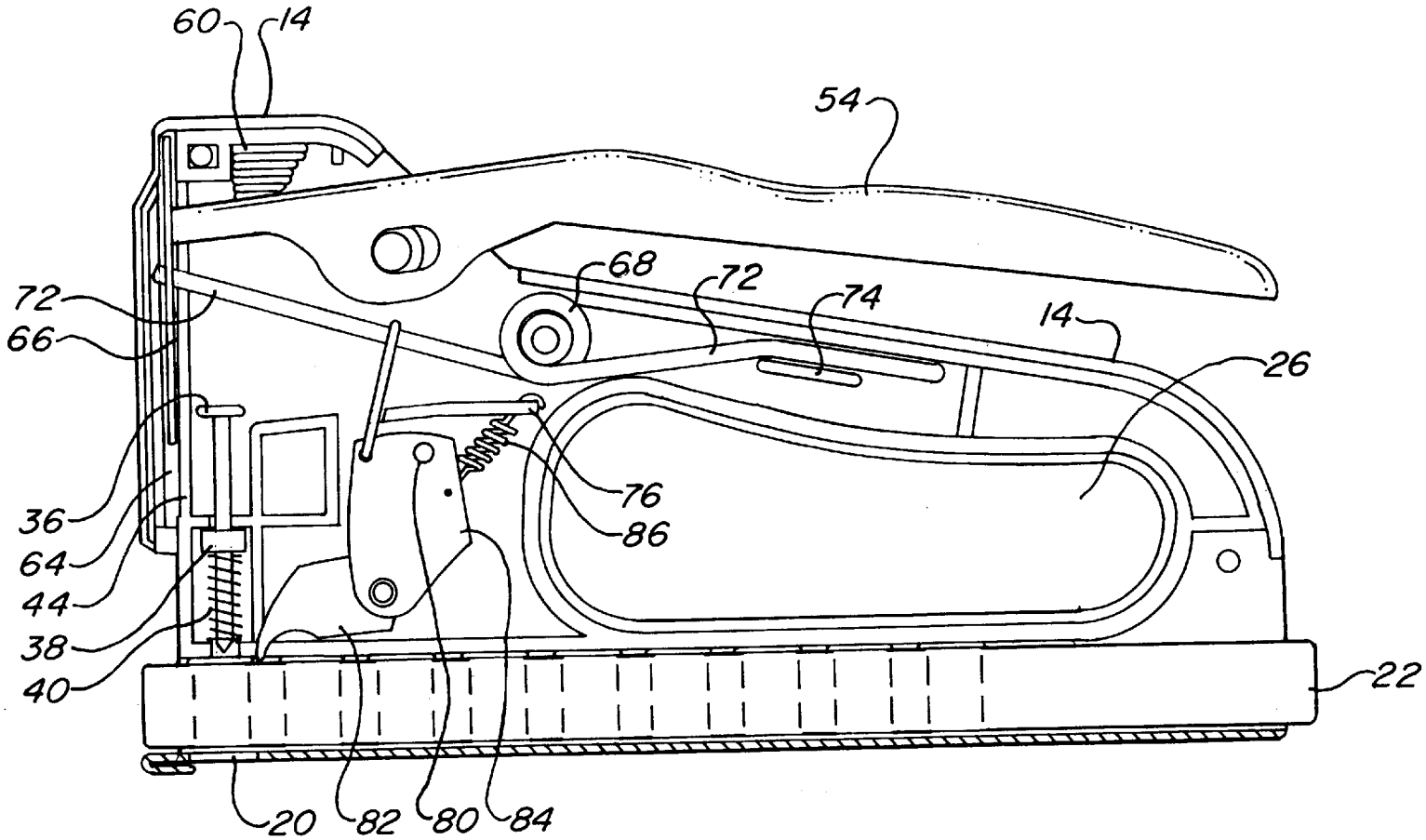
FIG. 3 is a side elevation view of the pistol, with the cover removed, during the firing process.

As best seen in FIGS. 2–4, located within the housing 12 are three main components, the trigger, the firing pin, and the advancement mechanism.

As seen, the firing pin 30 is comprised of a shaft 32 having a pointed end 34 and a strike plate 36 with an encompassing stop 38 positioned therebetween and biased by a spring 40 against the lower wall 16. The firing pin, which is positioned above the open channel's opening 20 and protruding through a opening 20 on the lower wall 16, is disposed between a side flange 42 and a side wall 44 of the housing 12 and protrudes through an opening 46 on a retainment flange 48.

As further seen, the trigger is comprised of a lever 50 having an actuation end 52 and a squeeze end 54. The lever 50 is pivotally attached to a pivot post 56 within the housing 12 which passes through an elongate slot 58 on the lever 50. A spring 60 has one end abutting the upper wall 14 of the housing 12 and the opposing end abutting the actuation end 52 of the lever 50. This end of the spring 60 can but need not be attached to the actuation end 52. A plate 62 is adapted to slide within a vertical channel 64 within the housing 12 and has an opening 66 through which the tip of the actuation end 52 of the lever 50 passes. A hammer spring 68, having a first arm 70 and a second arm 72, is attached within the housing 12. A bias flange 74 positions the second arm 72 against the upper wall 14 of the housing 12. The end of the first arm 70 passes through the opening 66 on the plate 62. The first arm 70 rests in a normally lowered position upon a stop flange 76 as seen in FIG. 2. In this position, the first arm places a small bias force onto the strike plate 36.

As also seen, the advancement mechanism is comprised of the aforementioned hammer spring 68 and a sear 78 pivotally attached to the housing 12 at pivot point 80. The sear 78 has a lower leg 82 pivotally attached to an upper leg 84 with the legs 82 and 84 positioned in normally folded relation as seen in FIG. 2. A return spring 86 has one end attached to the upper leg 84 and the opposing end attached to the housing 23. A connect rod 88 has one end attached to the upper leg 84 and the opposing end wrapped around the first arm 70 and can slide along a portion of the first arm 70.

In order to utilize the pistol 10 of the present invention, a cartridge C is placed into each chamber 24 of the magazine 22. The magazine 22 is slid into the open channel 18 through the rear opening and is advanced through the open channel 18 until the end of the magazine 22 abuts the protruding firing pin. The device 10 is now in a ready position which is illustrated in FIG. 2. As seen in this figure, the pivot post 56 is positioned at the top of the elongate slot 58 and is held there by the force of the lever spring 60.

An operator grasps the open portion 26 and contacts the lever 50 with his hand. The operator squeezes the lever 50 with his hand causing the squeeze end 54 to rotate downwardly while the actuation end 52 rotates upwardly. At the same time, the lever 50 shifts rearwardly so that the pivot post 56 is positioned at the bottom of the elongate slot 58. As the actuation end 52 rotates upwardly, it carries with it the plate 62. The plate 62 in turn carries with it the first arm 72 which releases its contact with the strike plate 36. The bias of the pin spring 40 causes the firing pin to retract into housing 12. The upwardly traveling first arm 70 carries with it the connect rod 88 which slides along the first arm 70 toward the second arm 72. The connect rod 88 carries with it the upper leg 84 causing the lower portion of the upper leg 84 to rotate forwardly thereby forcing the lower leg 82 to move forwardly. The end of the lower leg 82 contacts the head of a cartridge C and pushes the cartridge C, and thus the entire magazine 22, forwardly with forward advancement of the lower leg 82.

Upon further lever 50 pivot, the arcuate path of the lever 50 causes the actuation end 52 to fall out of its opening 66 on the plate 62 and thereby disengage from the plate 62. As the lever 50 is disengaged from the plate 62 the first arm 70 of the hammer spring 68 is forced downwardly and strikes the strike plate 36 of the firing pin causing the firing pin to impart a force onto the head H of the cartridge C thereby firing the cartridge C. The downward traveling first arm 70 returns the plate 62 to the lower position and also permits the return spring 86 to return the upper leg 84 and lower leg 82 to return into folded relation. Once the operator releases the squeeze end 54 of the lever 50, the lever spring 60 returns the lever 50 into its ready position. The actuation end 52 automatically reenters the opening 66 on the plate 62.

If an operator desires to remove the magazine 22 from the open channel 18 without the necessity of firing the cartridges C, the lever 50 is partially squeezed in order to retract the firing pin and the magazine 22 is slid out of the open channel 18.

While the invention has been particularly shown and described with reference to an embodiment thereof, it will be appreciated by those skilled in the art that various changes in form and detail may be made without departing from the spirit and scope of the invention.

I claim:

1. A pistol for firing a cartridge, the cartridge having a head and a mouth, comprising:

a housing having an open channel with an opening located generally normal to the longitudinal axis of the open channel;

a firing pin located within the housing and positioned above the opening;

a trigger operatively connected to the firing pin so as to cause the firing pin to impact a force onto the head of a cartridge, positioned within the open channel with the mouth facing the opening, when squeezed by a hand of an operator;

a magazine having a plurality of chambers, each chamber adapted to hold the cartridge, and adapted to slide within the open channel;

a hammer spring having a first arm held against an upper wall of the housing, and a second arm in a normally lowered position;

a sear, having a first leg and a second leg positioned in a normally folded relation, pivotally attached to the housing;

a return spring having a first end attached to the housing and a second end attached to the first leg;

a connect rod having a third end attached to the first leg and a fourth end connected to the first arm and adapted to slide along a portion of the first arm; and whereas squeezing of the trigger causes the first arm to articulate upwardly causing the fourth end to slide toward the second arm causing the first leg and the second leg to move to a generally unfolded relation and thereby pushing on the head of the cartridge within the magazine and where the return spring returns the first leg and second leg into folded relation upon the first arm returning into the normally lowered position.

2. The pistol as in claim 1 further comprising a magazine having at least one chamber, each chamber adapted to hold the cartridge, and adapted to slide within the open channel.

3. The pistol as in claim 1 wherein the trigger comprises:

a lever, having a fifth end and a sixth end for squeezing by the operator, pivotally disposed within the housing;

a first spring having a seventh end abutting the upper wall and an eight end abutting the fifth end;

a channel;

a plate, disposed within the channel, and holding the end of the first arm so that as the lever is squeezed the lever engages the plate and pushes it upwardly raising the first arm and as the lever further pivots the lever disengages from the plate causing the first arm to return to the normally lowered position and thereby causing the first arm to impact a force onto the firing pin.

4. The pistol as in claim 3 further comprising a pivot post disposed within the housing and passing through an elongate slot on the lever.

5. The pistol as in claim 3 further comprising a second spring having a ninth end abutting a lower wall of the housing and a tenth end abutting a stop encompassing the firing pin.

6. The pistol as in claim 1 wherein the housing has an open portion defining a hand grip.

7. A pistol for firing a cartridge, the cartridge having a head and a mouth, comprising:

a housing having an open channel with an opening located generally normal to the longitudinal axis of the open channel;

a firing pin located within the housing and positioned above the opening;

a trigger operatively connected to the firing pin so as to cause the firing pin to impact a force onto the head of a cartridge, positioned within the open channel with the mouth facing the opening, when squeezed by a hand of an operator, the trigger comprising:

a hammer spring having a first arm held against an upper wall of the housing and a second arm in a normally lowered position;

a lever, having a first end and a second end for squeezing by the operator, pivotally disposed within the housing;

a first spring having a third end abutting the upper wall of the housing and an fourth end abutting the first end;

a channel; and a plate, disposed within the channel, and holding the end of the first arm so that as the lever is squeezed the lever engages the plate and pushes it upwardly raising the first arm and as the lever further pivots the lever disengages from the plate causing the first arm to return to the normally lowered position and thereby causing the first arm to impact a force onto the firing pin.

8. The pistol as in claim 7 further comprising a pivot post disposed within the housing and passing through an elongate slot on the lever.

9. The pistol as in claim 7 further comprising a spring having a fifth end abutting a lower wall of the housing and a sixth end abutting a stop encompassing the firing pin.

10. The pistol as in claim 7 further comprising a magazine having a plurality of chambers, each chamber adapted to hold the cartridge, and adapted to slide within the channel.

11. The pistol as in claim 10 further comprising means for advancement for advancing in succession each of the plurality of chambers into position between the firing pin and the opening responsive to the trigger actuation.

12. The pistol as in claim 11 wherein the means for advancement comprises:

a sear, having a first leg and a second leg positioned in a normally folded relation, pivotally attached to the housing;

a return spring having a fifth end attached to the housing and a sixth end attached to the first leg;

a connect rod having a seventh end attached to the first leg and a eight end connected to the first arm and adapted to slide along a portion of the first arm; and whereas squeezing of the trigger causes the first arm to articulate upwardly causing the eighth end to slide toward the second arm causing the first leg and the second leg to move to a generally unfolded relation and thereby pushing on the head of the cartridge within the magazine and where the return spring returns the first leg and second leg into folded relation upon the first arm returning into the normally lowered position.

13. The pistol as in claim 7 wherein the housing has an open portion defining a hand grip.

14. A pistol for firing a cartridge, the cartridge having a head and a mouth, comprising:

a housing having an open channel with an opening located generally normal to the longitudinal axis of the open channel and an open portion therein for receiving a user's hand and defining a hand grip;

a firing pin located within the housing and positioned above the opening;

a trigger operatively connected to the firing pin so as to cause the firing pin to impact a force onto the head of a cartridge, positioned within the open channel with the mouth facing the opening, when squeezed by a hand of an operator.

15. The pistol as in claim 14 further comprising a magazine having at least one chamber, each chamber adapted to hold the cartridge, and adapted to slide within the open channel.

16. The pistol as in claim 14 further comprising a magazine having a plurality of chambers, each chamber adapted to hold the cartridge, and adapted to slide within the open channel.

17. The pistol as in claim 15 further comprising means for advancement for advancing in succession each of the plurality of chambers into position between the firing pin and the opening responsive to the trigger actuation.

18. The pistol as in claim 17 wherein the means for advancement comprises:

a hammer spring having a first arm held against an upper wall of the housing, and a second arm in a normally lowered position;

a sear, having a first leg and a second leg positioned in a normally folded relation, pivotally attached to the housing;

a return spring having a first end attached to the housing and a second end attached to the first leg;

a connect rod having a third end attached to the first leg and a fourth end connected to the first arm and adapted to slide along a portion of the first arm; and whereas squeezing of the trigger causes the first arm to articulate upwardly causing the fourth end to slide toward the second arm causing the first leg and the second leg to move to a generally unfolded relation and thereby pushing on the head of the cartridge within the magazine and where the return spring returns the first leg and second leg into folded relation upon the first arm returning into the normally lowered position.

19. The pistol as in claim 18 wherein the trigger comprises:

a lever, having a fifth end and a sixth end for squeezing by the operator, pivotally disposed within the housing;

a first spring having a seventh end abutting the upper wall and an eight end abutting the fifth end;

a channel; and a plate, disposed within the channel, and holding the end of the first arm so that as the lever is squeezed the lever engages the plate and pushes it upwardly raising the first arm and as the lever further pivots the lever disengages from the plate causing the first arm to return to the normally lowered position and thereby causing the first arm to impact a force onto the firing pin.

20. The pistol as in claim 19 further comprising a pivot post disposed within the housing and passing through an elongate slot on the lever.

21. The pistol as in claim 19 further comprising a second spring having a ninth end abutting a lower wall of the housing and a tenth end abutting a stop encompassing the firing pin.

22. The pistol as in claim 19 wherein the trigger comprises:

a hammer spring having a first arm held against an upper wall of the housing and a second arm in a normally lowered position;

a lever, having a first end and a second end for squeezing by the operator, pivotally disposed within the housing;

a first spring having a third end abutting the upper wall of the housing and an fourth end abutting the first end;

a channel; and a plate, disposed within the channel, and holding the end of the first arm so that as the lever is squeezed the lever engages the plate and pushes it upwardly raising the first arm and as the lever further pivots the lever disengages from the plate causing the first arm to return to the normally lowered position and thereby causing the first arm to impact a force onto the firing pin.

23. The pistol as in claim 22 further comprising a pivot post disposed within the housing and passing through an elongate slot on the lever.

24. The pistol as in claim 22 further comprising a spring having a fifth end abutting a lower wall of the housing and a sixth end abutting a stop encompassing the firing pin.

25. The pistol as in claim 22 further comprising a magazine having a plurality of chambers, each chamber adapted to hold the cartridge, and adapted to slide within the channel.

26. The pistol as in claim 25 further comprising means for advancement for advancing in succession each of the plurality of chambers into position between the firing pin and the opening responsive to the trigger actuation.

27. The pistol as in claim 26 wherein the means for advancement comprises:

a sear, having a first leg and a second leg positioned in a normally folded relation, pivotally attached to the housing;

a return spring having a fifth end attached to the housing and a sixth end attached to the first leg;

a connect rod having a seventh end attached to the first leg and a eight end connected to the first arm and adapted to slide along a portion of the first arm; and whereas squeezing of the trigger causes the first arm to articulate upwardly causing the eighth end to slide toward the second arm causing the first leg and the second leg to move to a generally unfolded relation and thereby pushing on the head of the cartridge within the magazine and where the return spring returns the first leg and second leg into folded relation upon the first arm returning into the normally lowered position.

* * * * *